United States Patent [19]

Sato et al.

[11] 4,116,846

[45] Sep. 26, 1978

[54] HYDRAULIC FLUID COMPOSITIONS COMPRISING BORATE ESTERS

[75] Inventors: Teruyuki Sato; Kunio Kawakatsu, both of Kyoto, Japan

[73] Assignee: Sanyo Chemical Industries, Ltd., Kyoto, Japan

[21] Appl. No.: 800,111

[22] Filed: May 24, 1977

[30] Foreign Application Priority Data

May 28, 1976 [JP] Japan ..... 51-62628

[51] Int. Cl.[2] ..... C10M 3/48; C10M 3/20

[52] U.S. Cl. ..... 252/78.1

[58] Field of Search ..... 252/78.1, 73

[56] References Cited

U.S. PATENT DOCUMENTS 3,711,410 1/1973 Sawyer et al. ..... 252/78.1
3,925,223 12/1975 Coffman et al. ..... 252/78.1
3,972,822 8/1976 Sato et al. ..... 252/78.1

FOREIGN PATENT DOCUMENTS 2,165,875 8/1973 France.
2,438,038 2/1975 Fed. Rep. of Germany.

*Primary Examiner*—Harris A. Pitlick
*Attorney, Agent, or Firm*—Oblon, Fisher, Spivak, McClelland & Maier

[57] ABSTRACT

Hydraulic fluid compositions having a high boiling point and a boron content of 0.2 to 1.6% by weight are formed from (a) a reaction product of (i) a polyalkylene glycol monoalkyl ether, (ii) a polyalkylene glycol or (iii) a polyoxyalkylene mono- or poly- ol having a molecular weight of 1000 to 5000, with (iv) a boron compound; (b) a polyalkylene glycol monoalkyl ether; (c) a polyalkylene glycol and (d) a polyoxyalkylene mono- or poly- ol having a molecular weight of 1000 to 5000.

12 Claims, No Drawings

HYDRAULIC FLUID COMPOSITIONS COMPRISING BORATE ESTERS

BACKGROUND OF THE INVENTION

1. Field of the Invention

This invention relates to hydraulic fluid compositions, particularly brake fluid compositions for use in hydraulic brake systems of automobiles.

2. Description of the Prior Art

Recently, automobiles have tended to become faster and larger, at the same time that greater safety is required. For this purpose, hydraulic fluids of higher performance are strongly demanded.

The first requirement for hydraulic fluids is to be free from the so-called "vapor lock phenomenon". This phenomenon is caused by the vaporization of hydraulic fluids and makes brake control impossible. Consequently, brake fluids having a higher boiling point are demanded. Efforts have been made to develop hydraulic fluids having a high boiling point even in the moist state and which can maintain the higher boiling point for a long period of time. the conventional hydraulic fluids which contain a high molecular weight polyether as base polymer and a low molecular weight glycol ether as diluent, are hygroscopic and tend to suffer a severe drop in their boiling points attendant upon moisture absorption. Such hydraulic fluids are therefore unlikely to pass the standard of DOT 4 (higher than 155° C) with respect to the wet equilibrium reflux boiling point (boiling point in a moist state), according to the hydraulic fluid specification of U.S. Department of Transportation [DOT]). Hitherto, there have been proposed several hydraulic fluids which contain borate esters of glycol ethers. Such hydraulic fluids may be adequate regarding their wet equilibrium reflux boiling points, but are not effective in inhibiting the inherent hydrolyzability of the borate esters. A need exists therefore, for hydraulic fluids having a high resistance to hydrolysis and at the same time a high enough wet equilibrium reflux boiling point to pass the standard of DOT 4.

SUMMARY OF THE INVENTION

Accordingly, it is one object of this invention to provide hydraulic fluid compositions which can meet the requirements for DOT 4 grade.

It is another object of this invention to provide hydraulic fluid compositions which have high boiling points, low sensitivity to water and high stability to hydrolysis.

It is yet another object of this invention to provide brake fluid compositions which are useable under severe conditions without causing vapor lock or precipitation of a boric compound.

Briefly, these and other objects of the invention as hereinafter will become more readily apparent have been attained broadly by providing hydraulic fluid compositions having a boron content of 0.2 to 1.6 % by weight comprising components (a), (b), (c) and (d): (a) at least one reaction product of components (i) to (iii) with component (iv), wherein, (i) is at least one polyglycol monether having the formula (1):

$$R_1\text{-}(OA_1)_m\text{-}OH \quad (1)$$

(wherein $R_1$ is $C_1$ – $C_4$ alkyl, $A_1$ is $C_2$-$C_3$ alkylene and $m$ is 2 to 8), (ii) is at least one polyglycol having the formula (2):

$$H\text{-}(OA_2)_n\text{-}OH \quad (2)$$

(wherein $A_2$ is $C_2$-$C_3$ alkylene and $n$ is 2 to 10)

(iii) is at least one polyoxyalkylene mono- or polyol having the formula (3):

$$R_2[(OA_3)_q\text{-}OH]_p \quad (3)$$

(wherein $R_2$ is a residue of $C_1$-$C_8$ mono-ol or $C_1$-$C_8$ polyol, $A_3$ is $C_2$-$C_3$ alkylene, $p$ is 1 to 4 and $q$ is a number such that the molecular weight of component (iii) is 1,000 to 5000), and (iv) is a boron compound able to form borate esters with said components (i)–(iii);

(b) is at least one polyglycol monoether having the formula (4):

$$R_3\text{-}(OA_4)_a\text{-}OH \quad (4)$$

(wherein $R_3$ is $C_1$-$C_4$ alkyl, $A_4$ is $C_2$-$C_3$ alkylene and $a$ is 2 to 8) (c) is at least one polyglycol having the formula (5):

$$H\text{-}(OA_5)_b\text{-}OH \quad (5)$$

(wherein $A_5$ is $C_2$-$C_3$ alkylene and $b$ is 2-10) and (d) is at least one polyoxyalkylene mono- or poly- ol having the formula (6):

$$R_4[(OA_6)_c\text{-}OH]_d \quad (6)$$

wherein $R_4$ is a residue of $C_1$-$C_8$ mono- ol or $C_1$-$C_8$ polyol, $A_6$ is $C_2$-$C_3$ alkylene, $d$ is 1 to 4 and $c$ is a number such that the molecular weight of component (d) is 1000 to 5000).

DETAILED DESCRIPTION OF THE PREFERRED EMBODIMENTS

Suitable polyglycol monoethers (i) include monomethyl, monoethyl, monopropyl (n- and iso-), and monobutyl (n-, iso-, sec-, and tert-) ethers of polyalkylene glycol such as diethylene glycol, triethylene glycol, tetraethylene glycol, pentaethylene glycol, hexaethylene glycol, heptaethylene glycol, oxtaethylene glycol, dipropylene glycol, tripropylene glycol, tetrapropylene glycol, addition products of 1 to 5 moles of propylene oxide (PO) each with ethylene glycol, diethylene glycol, triethylene glycol and tetraethylene glycol, and mixtures thereof. Preferred are diethylene glycol monomethyl ether, triethylene glycol monomethyl ether, tetraethylene glycol monomethyl ether, pentaethylene glycol monomethyl ether, hexaethylene glycol monomethyl ether, triethylene glycol monoethyl ether, triethylene glycol monobutyl ether, tetraethylene glycol monoethyl ether, tetraethylene glycol monobutyl ether, and addition products of 1 to 3 moles of PO with diethylene glycol monomethyl ether or triethylene glycol monomethyl ether. More preferred are triethylene glycol monomethyl ether, triethylene glycol monoethyl ether, triethylene glycol monobutyl ether, tetraethylene glycol monomethyl ether, tetraethylene glycol monoethyl ether and tetraethylene glycol monobutyl ether.

Suitable polyglycols (ii) include, for example, diethylene glycol, triethylene glycol, tetraethylene glycol, polyethylene glycol (M.W. [an average molecular weight] 200-300), tripropylene glycol, polypropylene glycol (M.W. 200-400) and random reaction products of ethylene oxide (EO) and PO with ethylene glycol or diethylene glycol (M.W. 200-400). Preferred are diethylene glycol, triethylene glycol and polyethylene (M.W. 200-300).

In this specification all molecular weight are number average and are measured by hydroxyl number (hydroxyl value).

Suitable polyoxyalkylene mono- or poly-ols (iii) include, for example, random addition products of ethylene oxide and propylene oxide with mono-ols (monohydric alcohols such as methanol, ethanol, propanol and butanol): addition products of propylene oxide with poly-ols (polyhydric alcohols such as ethylene glycol, propylene glycol, glycerine, trimethylol propane and pentaerythritol); and random addition products of ethylene oxide and propylene oxide with the foregoing poly-ols. Preferred are random addition products of ethylene oxide and propylene oxide with butanol, addition products of propylene oxide with glycerine and random addition products of ethylene oxide and propylene oxide with glycerine. Polyoxyalkylene mono- or polys-ols having a molecular weight of less than 1000 do not provide fluids having sufficient lubricity at high temperatures. Polyoxyalkylene mono- or poly-ols having a molecular weight of more than 5000 result in too great a kinematic viscosity at low temperatures (−40° C). In formula (3), $R_2$ is a residue of a $C_1$-$C_8$ mono- or $C_1$-$C_8$ poly-ol, from which at least one hydroxyl group is eliminated.

Suitable boron compounds (iv) having an ability to form borate esters, include boric anhydride, orthoboric acid and metaboric acid. Among them, boric anhydride is preferred. The reaction products (borate esters) of components (i) to (iii) with component (iv) can easily be synthesized in general by heating (i) to (iv) at, for example, 50° to 200° C under reduced pressure, for example, at 100 to 1 mmHg. The reaction is preferably carried out until the boron compound is completely esterified. The foregoing borate esters include mixtures of compounds having the formula (7):

$$\begin{array}{l} \quad [\,O(A_1O)_mR_1\,]_x \\ B(O(A_2O)_nH\,]_y \\ \quad O\{\,(A_3O)_qR_2(\,OA_3)_qOH\,]_{p-1}\,\}_z \end{array} \qquad (7)$$

wherein $x$, $y$ and $z$ are independently zero or an integer from 1 to 3, and satisfy the equation $x + y + z = 3$, and the other symbols are as defined above.

Polyglycol monoethers (b) include the same ones as described for component (i). In the hydraulic fluids of this invention, components (b) and (i) can independently be selected, in other words, they may be the same or different. Polyglycols of the formula (c) also include the same ones as described for component (ii). In the hydraulic fluid of this invention, components (c) and (ii) can be independently selected. Polyoxyalkylene mono- or poly-ols of the formula (d) include the same ones as described for component (iii). In the hydraulic fluid of this invention, (d) and (iii) can be independently selected.

In the hydraulic fluid compositions of this invention, the blending ratios of (a), (b), (c) and (d) are not especially critical, but preferably the total amount of (i) in (a) and (b) is 30 to 90% by weight, the total amount of (ii) in (a) and (c) is 5 to 50% by weight and the total amount of (iii) in (a) and (d) is 1 to 20% by weight, based on the total weight of (a), (b), (c) and (d). The hydraulic fluid compositions of this invention have a boron content of 0.2 to 1.6% by weight. When the content is less than 0.2% by weight, the wet equilibrium reflux boiling point does not pass the standard of DOT 4, while when the content exceeds 1.6% by weight, the resistance to hydrolysis of the borate esters becomes insufficient.

Methods for producing the brake fluid compositions of this invention are not especially critical. For example, they may be produced by mixing (i), (ii), (iii) and (iv) and reacting them to obtain mixtures which contain the reaction products (a) and unreacted (excess) (i), (ii) and (iii) as (b), (c) and (d), respectively; or by mixing (i), (ii), (iii) and (iv), reacting them to obtain the reaction products (a) and thereafter adding (b), (c) and (d). In the hydraulic fluid compositions of this invention, the presence of component (iii) in the reaction product (a) is desirable because otherwise the lubricity of the fluids becomes poor.

Additional components (e) may be incorporated into the hydraulic fluid compositions of this invention. Suitable such components include antioxidants such as phenyl-alphanaphthylamine, di-n-butyl amine, 2,4-dimethyl-6-tert-butyl phenol or 4,4,-butylidene bis (6-tert-butyl-m-cresol); corrosion inhibitors such as alkanolamines (including mono, di and triethanolamines), morpholine, cyclohexylamine, benzotriazole or mercaptobenzothiazole; rubber age resistors such as 2,4-dimethyl-6-tert-butylphenol; pH adjusters such as mono, di and triethanolamine and the like. The total amount of these components is usually 0 to 10% (preferably 0.1 to 5%) by weight based on the total weight of the fluid composition.

The hydraulic fluid compositions of this invention satisfy completely the requirement for a good brake fluid in the tests of viscosity, stability at high temperature, cold temperature resistance, resistance to rubber swelling property and corrosion. Moreover, they have the requisite small decrease of boiling point (wet reflux boiling point) and good resistance to hydrolysis, so that they pass the DOT 4 test. Having generally described the invention, a more complete understanding can be obtained by reference to certain specific examples, which are included for purposes of illustration only and are not intended to be limiting unless otherwise specified. In the examples, EO and PO designate ethylene oxide and propylene oxide, respectively, M.W. designates an average molecular weight and EO/PO = 50/50 (by wt.) designates a ratio of EO to PO = 50 : 50 by weight.

EXAMPLE 1

A mixture having the following composition (components and mixing ratios) was reacted at 120° C and 20 mmHg pressure to obtain a hydraulic fluid composition according to the invention.

| | % by weight |
|---|---|
| $B_2O_3$ | 2.8 |
| $CH_3(OCH_2CH_2)_3OH$ | 53.2 |
| $C_4H_9(OCH_2CH_2)_3OH$ | 5.0 |
| $CH_3(OCH_2CH_2)_3(OCH_2CH(CH_3))OH$ | 16.0 |

-continued

| | % by weight |
|---|---|
| $CH_3(OCH_2CH_2)_3(OCH_2CH(CH_3))_2OH$ | 5.0 |
| $H(OCH_2CH_2)_nOH$ (M.W. 200) | 15.0 |
| A random addition product of EO and PO with glycerine (EO/PO = 50/50 (by wt.), M.W. 2800) | 3.0 |

EXAMPLE 2

A mixture having the following composition (components and mixing ratios) was reacted at 100° C and 5 mmHg pressure to obtain a hydraulic fluid composition according to the invention.

| | % by weight |
|---|---|
| $B_2O_3$ | 2.0 |
| $CH_3(OCH_2CH_2)_2OH$ | 6.0 |
| $C_4H_9(OCH_2CH_2)_2OH$ | 25.0 |
| $CH_3(OCH_2CH_2)_3OH$ | 13.0 |
| $CH_3(OCH_2CH_2)_4OH$ | 16.0 |
| $CH_3(OCH_2CH_2)_5OH$ | 10.0 |
| $CH_3(OCH_2CH_2)_6OH$ | 3.0 |
| $H(OCH_2CH_2)OH$ (M.W. 200) | 20.0 |
| A random addition product of EO and PO with glycerine (EO/PO = 50/50 (by wt.), M.W. 2800) | 5.0 |

EXAMPLE 3

A mixture having the following composition (components and mixing ratios) was reacted at 120° C and 10 mmHg pressure to obtain a hydraulic fluid composition according to the invention.

| | % by weight |
|---|---|
| $H_3BO_3 \cdot 4H_2O$ | 5.0 |
| $CH_3(OCH_2CH_2)_2OH$ | 5.0 |
| $CH_3(OCH_2CH_2)_3OH$ | 34.0 |
| $C_4H_9(OCH_2CH_2)_3OH$ | 15.0 |
| $CH_3(OCH_2CH_2)_4OH$ | 12.0 |
| $CH_3(OCH_2CH_2)_5OH$ | 7.0 |
| $CH_3(OCH_2CH_2)_6OH$ | 2.0 |
| $H(OCH_2CH_2)_nOH$ (M.W. 200) | 15.0 |
| An addition Product of PO with glycerine (M.W. 3000) | 5.0 |

EXAMPLE 4

A mixture having the following composition was reacted at 120° C and 10 mmHg pressure to obtain a hydraulic fluid composition according to the invention.

| | % by weight |
|---|---|
| $B_2O_3$ | 3.2 |
| $CH_3O(CH_2CH_2O)_2H$ | 6.8 |
| $C_4H_9O(CH_2CH_2O)_3H$ | 19.0 |
| $CH_3O(CH_2CH_2O)_3H$ | 23.0 |
| $CH_3O(CH_2CH_2O)_4H$ | 19.0 |

-continued

| | % by weight |
|---|---|
| $CH_3O(CH_2CH_2O)_5H$ | 12.0 |
| $CH_3O(CH_2CH_2O)_6H$ | 5.0 |
| $HO(CH_2CH_2O)_6H$ (M.W. 200) | 7.0 |
| Polypropylene glycol (M.W. 1200) | 5.0 |

EXAMPLE 5

A hydraulic fluid composition according to the invention having the following composition (components and mixing ratios) was prepared.

| | % by weight |
|---|---|
| The reaction product obtained in Example 4 | 40.0 |
| $CH_3O(CH_2CH_2O)_2H$ | 5.0 |
| $CH_3O(CH_2CH_2O)_3CH_2CH(CH_3)-OH$ | 35.0 |
| $CH_3O(CH_2CH_2O)_3(CH_2CH(CH_3)O)_2H$ | 15.0 |
| A random addition product of EO and PO with n-butanol (EO/PO = 50/50 (by wt.), M.W. 1500) | 5.0 |

EXAMPLE 6

The hydraulic fluid compositions of Examples 1–5 were tested according to the procedure of DOT 4 Specification. Pertinent data relating to these tests are shown in the Table.

Some of the physical properties were determined by the following procedures:

1. Reflux boiling point (wet)

The (equilibrium) reflux boiling point was measured after 100 ml. of a sample (brake fluid) was maintained in an atmosphere of 80% relative humidity for such time that 100 ml. of standard fluid (RM-1) specified by SAE (the Society of Automotive Engineers) absorbed 3% by weight of water under the same conditions.

2. Rubber swelling property

An SBR cup (base diameter 9/8 inch) for a brake cylinder was dipped in the brake fluid at 120° C for 70 hours and then measured for increase in base diameter.

TABLE

| Test | DOT 4 Specification | Example 1 | Example 2 | Example 3 | Example 4 | Example 5 |
|---|---|---|---|---|---|---|
| Reflux boiling point (dry)° C | >230 | 274 | 245 | 272 | 267 | 271 |
| Reflux boiling pont (wet)° C | >155 | 171 | 164 | 167 | 172 | 160 |
| Viscosity | | | | | | |
| 100° C., CS | >1.5 | 2.85 | 2.69 | 2.55 | 2.76 | 2.71 |
| −40° C., CS | <1800 | 1703 | 1634 | 1519 | 1272 | 1645 |
| Rubber swelling property (mm) | 0.15–1.4 | 0.45 | 0.63 | 0.40 | 0.60 | 0.53 |

Having now fully described the invention, it will be apparent to one of ordinary skill in the art that many changes and modifications can be made thereto without departing from the spirit or scope of the invention as set forth herein.

What is claimed as new and intended to be covered by letters patent is:

1. A hydraulic fluid composition having a boron content of 0.2 to 1.6% by weight comprising:

(a) a reaction product selected from the group consisting of the reaction product of (i) and (iii) with (iv); (i), (ii) and (iii) with (iv) and mixtures thereof, wherein:

(i) is at least one polyglycol monoether of the formula:

$$R_1\text{-}(OA_1)_m OH$$

wherein $R_1$ is $C_1$-$C_4$ alkyl, $A_1$ is $C_2$-$C_3$ alkylene and $n$ is 2 to 8;

(ii) is at least one polyglycol of the formula:

$$H\text{-}(OA_2)_n OH$$

wherein $A_2$ is $C_2$-$C_3$ alkylene and $n$ is 2 to 10;

(iii) is at least one polyalkylene mono- or poly-ol of the formula:

$$R_2[(OA_3)_q OH]_p$$

wherein $R_2$ is a residue of a $C_1$-$C_8$ mono-ol or $C_1$-$C_8$ poly-ol, $A_3$ is $C_2$-$C_3$ alkylene, $p$ is 1 to 4 and $q$ is a number such that the molecular weight of component (iii) is 1,000 to 5,000; and (iv) is at least one boron compound having an ability to form borate esters;

(b) at least one polyglycol monoether of the formula:

$$R_3\text{-}(OA_4)_a OH$$

wherein $R_3$ is $C_1$-$C_4$ alkyl, $A_4$ is $C_2$-$C_3$ alkylene and $a$ is 2 to 8;

(c) at least one polyglycol of the formula:

$$H\text{-}(OA_5)_b OH$$

wherein $A_5$ is $C_2$-$C_3$ alkylene and $b$ is 2 to 10; and (d) at least one polyoxyalkylene mono- or poly-ol of the formula:

$$R_4[(OA_6)_c OH]_d$$

wherein $R_4$ is a residue of a $C_1$-$C_8$ mono-ol or $C_1$-$C_8$ poly-ol, $A_6$ is $C_2$-$C_3$ alkylene, $d$ is 1 to 4 and $c$ is a number such that the molecular weight of component (d) is 1,000 to 5,000.

2. The hydraulic fluid composition of Claim 1, wherein 0–10% by weight, based on the total weight of the fluid composition, of at least one additional component (e) is incorporated (e), being selected from the group consisting of antioxidants, corrosion inhibitors, rubber age resisters, and pH adjusters.

3. The hydraulic fluid composition of claim 2, wherein the additional component is at least one member selected from the group consisting of corrosion inhibitors and antioxidants.

4. The hydraulic fluid composition of claim 1, wherein the total amount of polyglycol monoether is 30 to 90% by weight, the total amount of polyglycol is 5 to 50% by weight and the total amount of polyoxyalkylene mono- or poly-ol is 1 to 20% by weight, based on the total weight of (a), (b), (c) and (d).

5. The hydraulic fluid composition of claim 1, wherein the polyglycol monoether (i) and (b) independently are at least one member selected from the group consisting of triethylene glycol monomethyl ether, triethylene glycol monoethyl ether, triethylene glycol monobutyl ether, tetraethylene glycol monomethyl ether, tetraethylene glycol monoethyl ether and tetraethylene glycol monobutyl ether.

6. The hydraulic fluid composition of claim 1, wherein the polyglycol (ii) and (c) independently are at least one member selected from the group consisting of diethylene glycol, triethylene glycol and polyethylene glycol (M.W. 200–300).

7. The hydraulic fluid composition of claim 1, wherein the polyoxyalkylene mono- or poly-ol (iii) and (d) independently are at least one member selected from the group consisting of random addition products of ethylene oxide and propylene oxide with butanol, addition products of propylene oxide with glycerine and random addition products of ethylene oxide and propylene oxide with glycerine.

8. The hydraulic fluid composition of claim 1, wherein the boron compound (iv) in (a) is boric anhydride.

9. The hydraulic fluid composition of claim 2, wherein the additional component (e) is present in an amount of 0.1 – 5% by weight.

10. The hydraulic fluid composition of claim 1, wherein the reaction product (a) is the reaction product of (i), (ii) and (iii) with (iv).

11. The hydraulic fluid composition of claim 1, which is obtained by mixing an excess of (i), (ii) and (iii) with (iv) and reacting them to obtain mixtures which contain the reaction products (a) and unreacted (i), (ii) and (iii) as (b), (c) and (d) respectively.

12. The hydraulic fluid composition of claim 1, which is obtained by mixing an excess of (i), (ii) and (iii) with (iv), reacting them to obtain the reaction products (a) and thereafter adding (b), (c) and (d).

* * * * *